United States Patent [19]

Tom

[11] Patent Number: 5,003,796

[45] Date of Patent: Apr. 2, 1991

[54] MULTI-BOLT DOOR LOCK

[76] Inventor: Wilson Tom, No. 229, Pei-Tou Rd., Tsao-Tun Chen, Nan-Tu Hsien, Taiwan

[21] Appl. No.: 388,620

[22] Filed: Aug. 1, 1989

[51] Int. Cl.[5] ..... E05B 59/00

[52] U.S. Cl. ..... 70/107; 292/33

[58] Field of Search ..... 70/352, 107; 292/32, 292/33

[56] References Cited

U.S. PATENT DOCUMENTS

| | | | |
|---|---|---|---|
| 22,146 | 11/1858 | Moore | 70/352 |
| 78,962 | 6/1868 | Harrington | 70/107 |
| 89,931 | 5/1869 | Jones | 70/107 |
| 865,421 | 9/1907 | Müller | 70/107 |
| 1,554,513 | 9/1925 | McGeoch | 70/107 |

FOREIGN PATENT DOCUMENTS

| | | | |
|---|---|---|---|
| 585848 | 10/1933 | Fed. Rep. of Germany | 70/352 |
| 1173814 | 7/1964 | Fed. Rep. of Germany | 70/352 |

*Primary Examiner*—Lloyd A. Gall
*Attorney, Agent, or Firm*—Ladas & Parry

[57] ABSTRACT

A door lock which includes a first bolt mounted movably in a housing and biased to a latching position, and an elongated second bolt member lying in a vertical plane and mounted movably below the first bolt. A first actuating plate is provided adjacent the first notched face and turnable about a horizontal axis to push the notched face so that the second bolt is moved to a latching position or an unlatching position. A first locking plate is cooperatively associated with the second bolt and biased to move upward to a position in which the first locking plate locks the second bolt against movement. Improvements are provided such that the second bolt member further has a second notched face in the upper end near the rear end of the second bolt member, and a second actuating plate is provided adjacent to the second notched face to push the second notched face so as to move the second bolt member.

7 Claims, 11 Drawing Sheets

MULTI-BOLT DOOR LOCK

BACKGROUND OF THE INVENTION

This invention relates to a door lock, and particularly to a door lock including a spring-loaded bolt and a main bolt which is loaded with a spring and which can be operated by using key-operated lock members provided at both inner and outer sides of a door as well as a knob provided at the inner side of the same door.

FIG. 1 shows a conventional lock 10 which includes a main bolt 11 controlled by a locking member 17 and operable by a key-operated lock member 12 which actuates an actuating member 16. The lock further includes a spring-biased auxiliary bolt 13 which is operable by a pull member 14 and which can be locked against movement when in the latching position by a locking member 19 that is operable via a control knob 18. When such a lock is used, the user may operate the main bolt from the outside of a door through the key-operated lock member 12 and operate the auxiliary bolt from the inside of the door through the pull member 14. In addition, the locking member 19 can be operated through the knob 18 from the inside of the door so as to prevent the bolt 13 from movement when the bolt 13 is in the latching position. The arrangement of the locking member 19 and the knob 18 effectively prevents a person from unlocking the door from the outside. However, this has created a disadvantage in that, if a child turns the knob at the inside of the door, thus locking the auxiliary bolt 13 against movement and no adult who can operate the knob is present, the door will be unable to be opened from the outside by operating the door lock. A situation such as this may endanger the child locked within the room.

SUMMARY OF THE INVENTION

An object of the invention is to provide a door lock of the type described above with an improvement which enables the bolt of the door lock which is prevented from moving to an unlatching position by a locking member operable from the inside of the door to be released from the locking member by operating the door lock located outside of the door.

The invention provides improvements for a door lock which comprises a housing, a first bolt mounted movably to the housing and biased to a latching position, means for operating the first bolt externally, and an elongated second bolt member lying in the housing and mounted movably below the first bolt, the second bolt member having a forward latching end, an opposite rear end and a longitudinal upper end with a first notched face near the forward latching end. A pair of first actuating plates are provided adjacent the first notched face and are turnable about a horizontal axis to push the notched face so that the second bolt is moved to a latching position or an unlatching position. A locking plate is cooperatively associated with the second bolt and biased to move upward to a position in which the locking plate locks the second bolt against movement, the locking plate releasing the second bolt when depressed downward.

The door lock is characterized in that the second bolt member further has a second notched face in the upper end near the rear end of the second bolt member, and a second actuating plate is provided adjacent the second notched face to push the second notched face so as to move the second bolt member horizontally.

Further, there are provided a lever pivoted to the second bolt member and having a first end extending upward to engage with the first bolt member and a second end extending downward and a third actuating member operable from outside of the door and disposed adjacent to the second end of the lever to actuate the second end so as to move the first bolt member to its unlatching position, thereby enabling the first bolt member to be operated from the outside of the door. The second end of the lever moves away from the third actuating member when the second bolt member is moved to its latching position, thereby preventing the first bolt member from moving to the unlatching position from the outside of the door.

In one aspect of the invention, the door lock further comprises a first key-operated lock member which is mounted on a cover of the housing, and which is connected to one of the first actuating plates. A first operating knob is mounted on the inner wall of the housing and connected to the second actuating plate. A second key-operated lock member is mounted on the inner wall of the housing and connected to another of the first actuating plates.

In another aspect of the invention, the locking plate is of U-shaped cross-section and has two parallel side plates and a base interconnecting the parallel side plates. The second bolt member is provided between the parallel side plates, while the base lies below a longitudinal bottom end of the second bolt member and is biased upward. On the bottom end of the second bolt member there are a plurality of engaging holes to receive a projection or base provided on the base of the locking plates. Each parallel side plate has a first upper raised edge portion adjacent to and higher than the first notched face and a second upper raised edge portion adjacent to and higher than the second notched face.

The present exemplary preferred embodiment will be described in detail with reference to the accompanying drawings, in which:

DETAILED DESCRIPTION OF THE PREFERRED EMBODIMENT

Figure 1:
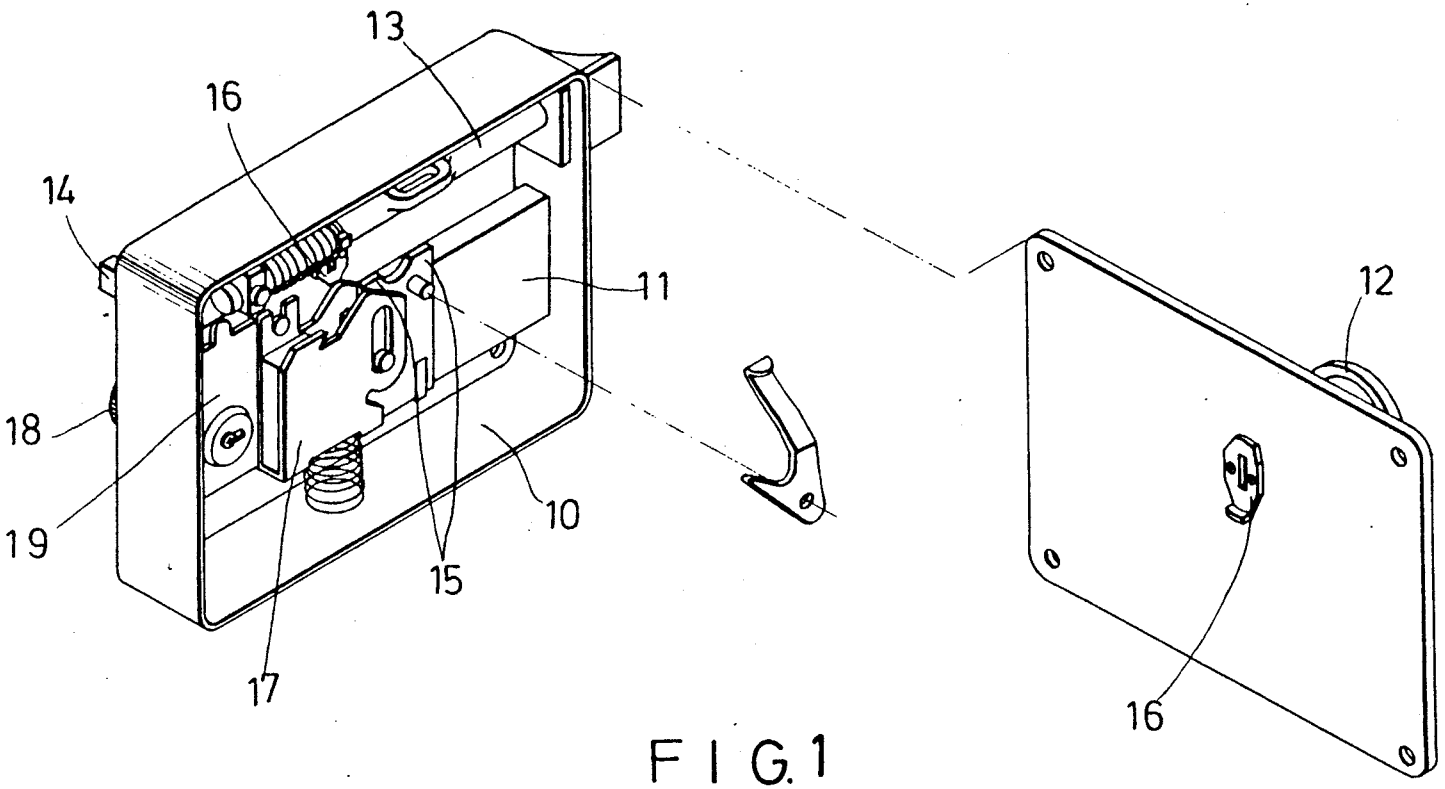
FIG. 1 PRIOR ART
FIG. 1 shows a conventional door lock.
Figure 2:
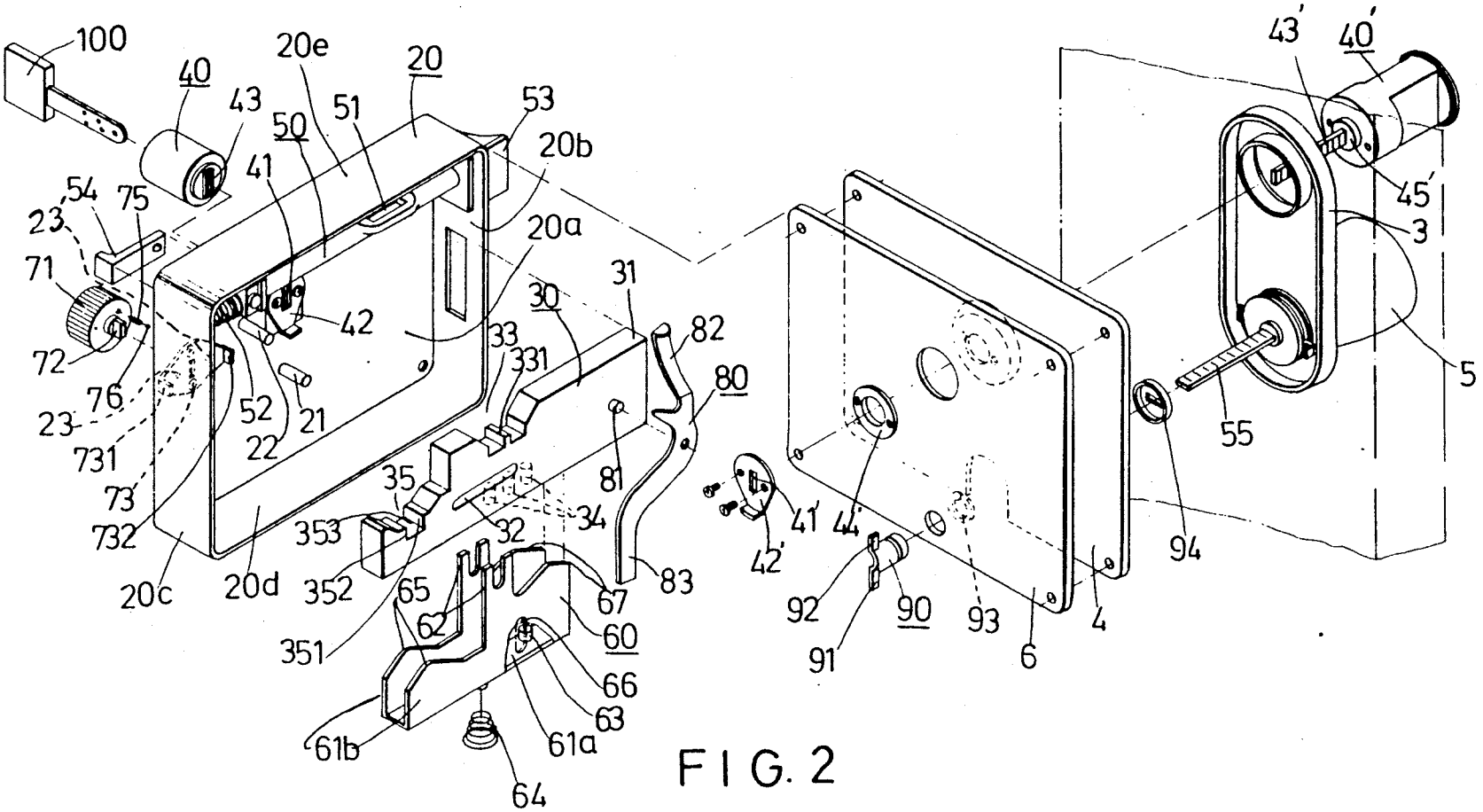
FIG. 2 is an exploded view of a door lock embodying the present invention.
Figure 3:
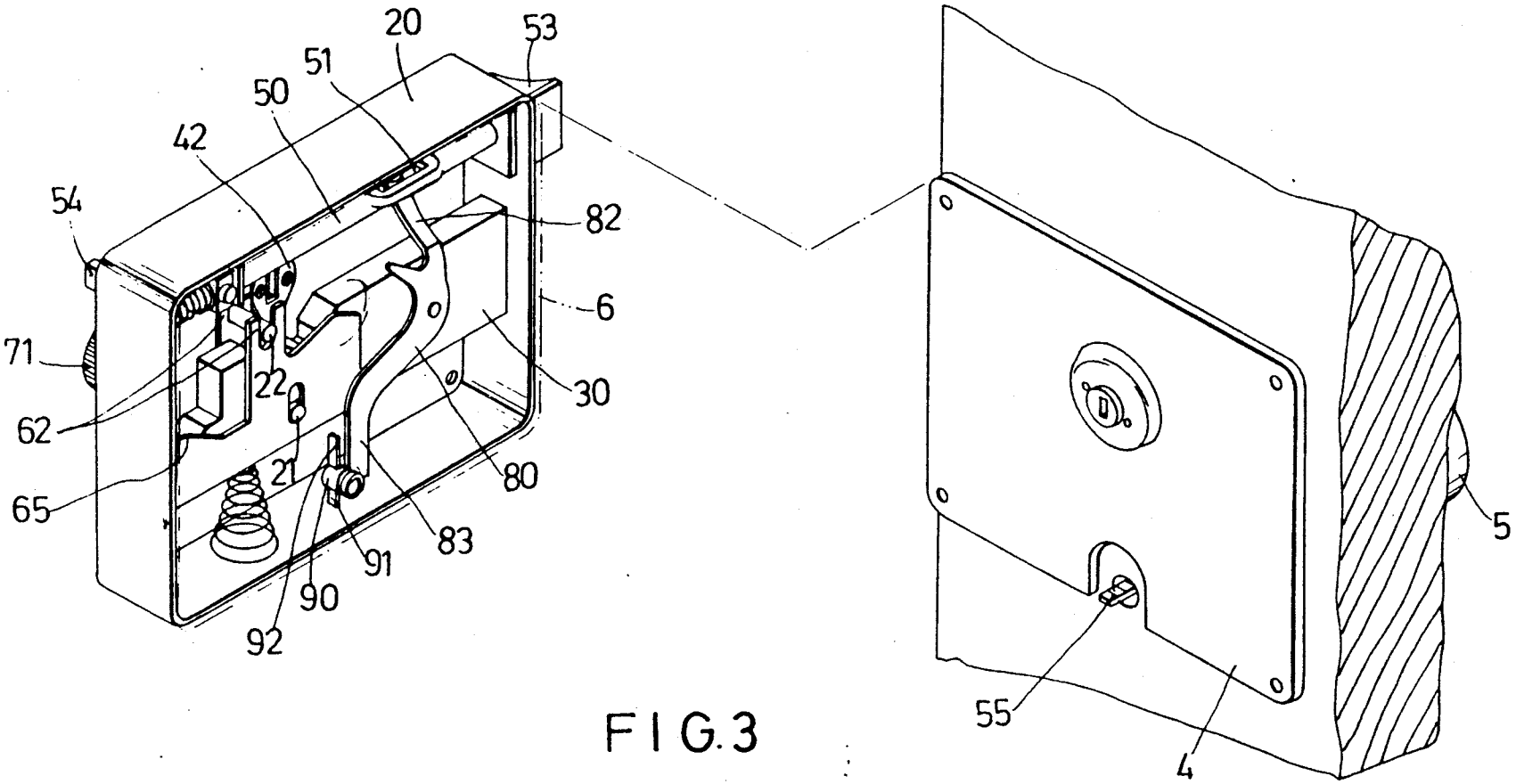
FIG. 3 is another exploded view of the door lock of FIG. 1.
Figure 4:
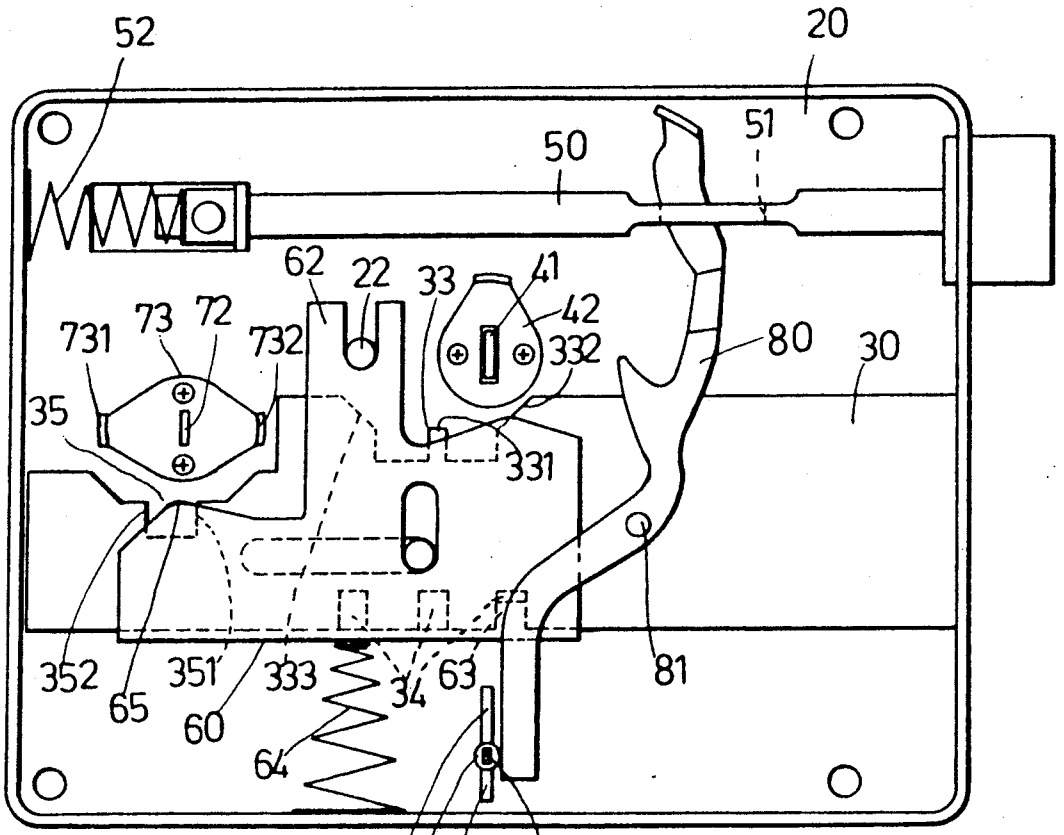
FIG. 4 is an elevation view of the door lock.

Referring to FIGS. 2, 3 and 4, a door lock of the invention is shown, including a housing 20 which is mounted on the inside of a door and has an inner wall 20*a*, two side walls 20*b*, 20*c*, a bottom wall 20*d* and a top wall 20*e*.

An inner key-operated lock 40 is attached to an inner wall 20*a* of the housing and an outer key-operated lock 40' is attached to an outside mounting plate 3 which is mounted on the outside of the door. The key-operated locks 40, 40' are conventional and therefore the details thereof are not described herein. The lock 40 has a projection 43 extending into a slot 41 of an actuating plate 42 which is mounted on the inner side of the inner wall 20*a*. The actuating plate 42 can be turned by using a key 100 which projects into the slot 41 of the plate 42 when inserted into the lock 40.

The lock 40' is provided with a shaft 43' which passes through a mounting plate 4 and a cover 6. An actuating plate 42' is fixed to a rotary plate 44' which is mounted on a rotary part 45' of the lock 40'. The shaft 43' extends into the slot 41' of the actuating plate 42' so that the actuating plate 42' is turned upon operation of the lock 40'.

Below the lock 40' is a knob 5 which is also mounted on the mounting plate 3. Since the construction of the knob 5 is known, the details thereof are not described herein. The knob 5 has a shaft 55 which passes through the mounting plate 4 and the cover 6 is mounted thereon by means of a cap-like plate 94 and a C-shaped clamp member 93. An actuating member 90 which is provided in the housing 20 is mounted on the shaft 55. The actuating member 90 is provided with two actuating flanks 91 and 92 which actuate a lever 80 when the knob 5 is operated.

The lever 80 is pivoted to a main bolt 30 by means of a boss 81 provided on the bolt 30. The lower end portion 83 of the lever 80 engages with the actuating member 90 and the upper end portion 82 thereof engages in a socket 51 of a spring-biased auxiliary bolt 50. The auxiliary bolt 50 is biased to a latching position by a helical spring 52 which is secured to the side wall 20*c* of the housing 20. When the knob is operated, the actuating member 90 moves the lever 80 which in turn moves the auxiliary bolt 50 to an unlatching position.

The main bolt 30 has a forward end portion 31 to extend out of the housing 20 through the forward side wall 20*b* when the bolt is in a latching position. The intermediate portion of the bolt 30 is received in a locking plate 60 which is of U-shaped cross-section and has a base member 61*a* interconnecting two spaced apart parallel members 61*b*. A slide opening 32 which is elongated in a horizontal direction is provided in the bolt 30. Two slots 66 which are elongated in a vertical direction are provided in the parallel members 61*b* of the locking plate 60 in such a manner that the slots 66 intersect with the slide opening 32. A locking pin 21 which is fixed to the housing 20 projects into the intersecting parts of the slide opening 32 and the slots 66. A coiled spring 64 is secured to the lower wall 20*d* of the housing 20 with the lower end thereof and supports the base wall 61*a* of the locking plate 60 with its upper end thereof, thereby placing the locking plate 60 in a position movable upward or downward.

The bolt 30 is further provided with a front notch 33 and a rear notch 35 at the upper edge thereof and three cylindrical recesses 34 below the slide opening 32. An upward projection 331 is formed in the notch 33. The rear notch 35 is stepped and has a deep recess 353 confined by a forward steep wall 351 and a rear steep wall 352. A cylindrical boss 63 is provided on the base member 61*a* of the locking plate 60 which is selectively inserted into one of the recesses 34. At the upper sides of parallel members 61*b* are two substantially inverted V-shaped raised forward edges 67 which are normally in alignment with the forward notch 33 of the bolt 30, and two substantially inverted V-shaped rear raised edges 65 which are normally in alignment with the notch 35 of the bolt 30. Between the forward and rear raised edges 67, 65 are two parallel U-shaped projecting parts 62. A pin 22, fixed to the wall of the housing 20, projects into the indentations of the U-shaped projecting parts 62. The pin 22 is used to maintain the locking plate 60 in a proper position.

A control knob 71 with a shaft 72 is provided on the inner wall 20*a* of the housing 20. The shaft 72, passing through the wall 20*a* of the housing 20, extends into a slot of an actuating plate 73 which is rotatably fixed on the wall 20*a* of the housing 20. The actuating plate 73 is provided with two opposite flanges 731, 732 and is located above the rear notch 35 of the bolt 30 and the inverted V-shaped raised rearward edges 65 of the locking plate 60 so that the bolt 30 and the locking plate 60 can be actuated by the actuating plate 73.

Figure 5:
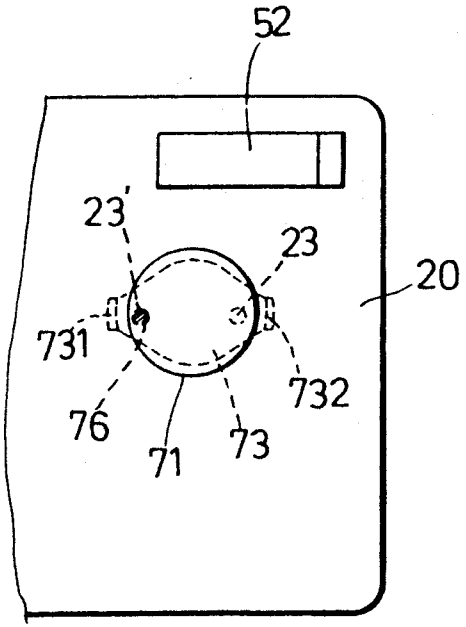
FIG. 5 is a fragmentary elevation view showing the inner side of the housing of the door lock.

Referring to FIG. 5 in combination with FIG. 2, two recesses 23, 23' are provided in the wall of the housing 20 adjacent to the knob 71 and a protrusion 76 biased by a spring 75 is provided on the side of the knob 71 contacting the wall of the housing 20 to engage selectively in one of the recesses 23, 23'. As is known in the art, the recesses 23, 23' and the protrusion 76 are employed for temporarily restraining the knob 71 and the actuating plate 73 against rotation.

The above-mentioned lock can be operated by selectively using the key-operated locks 40, 40', the knobs 5, 71 and a pull handle 54 of the auxiliary bolt 50.

Figure 6:
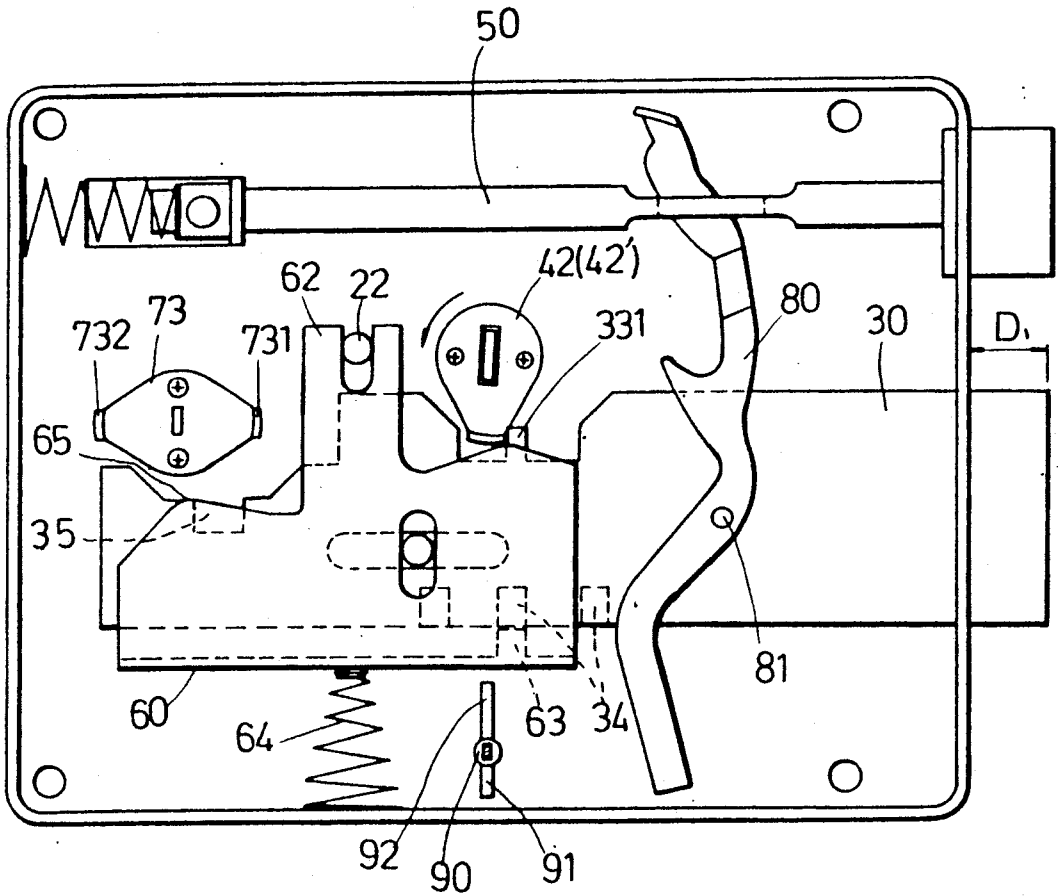
FIGS. 6, 7 and 8 show the operation of the first actuating plate of the door lock.
Figure 7:
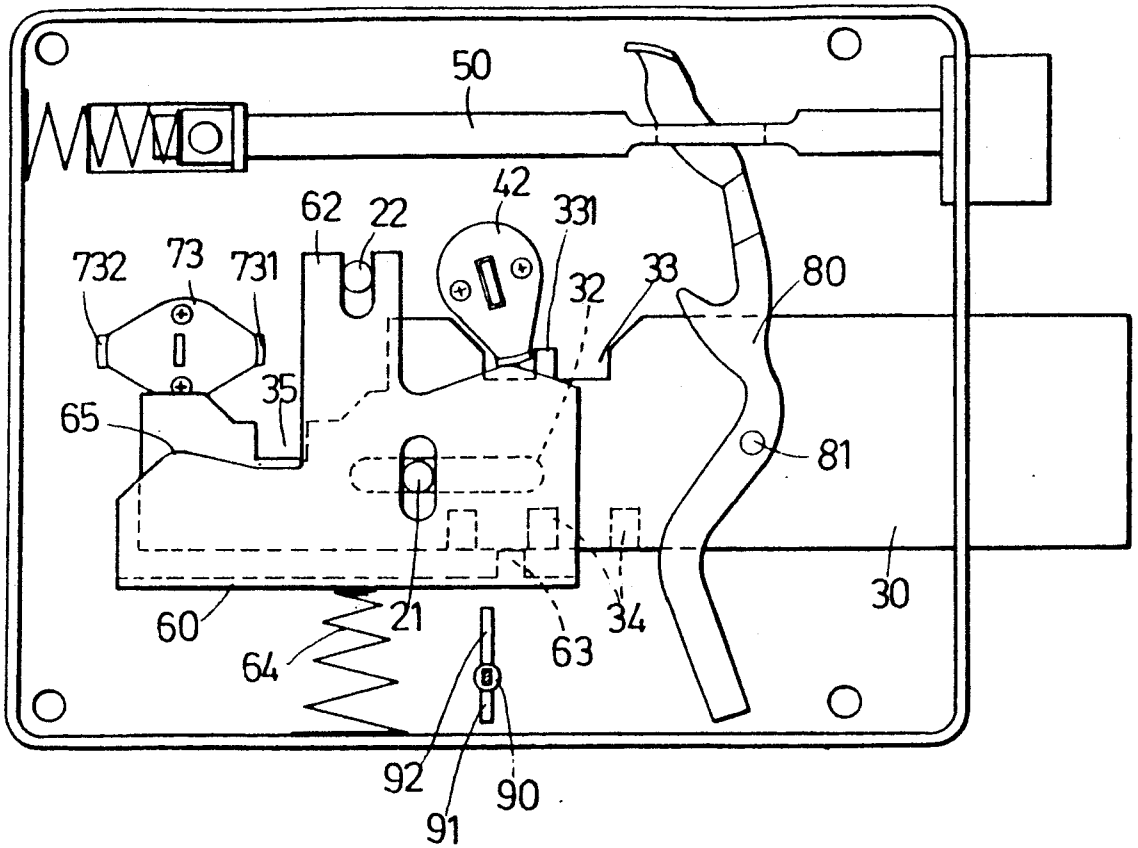
Figure 8:
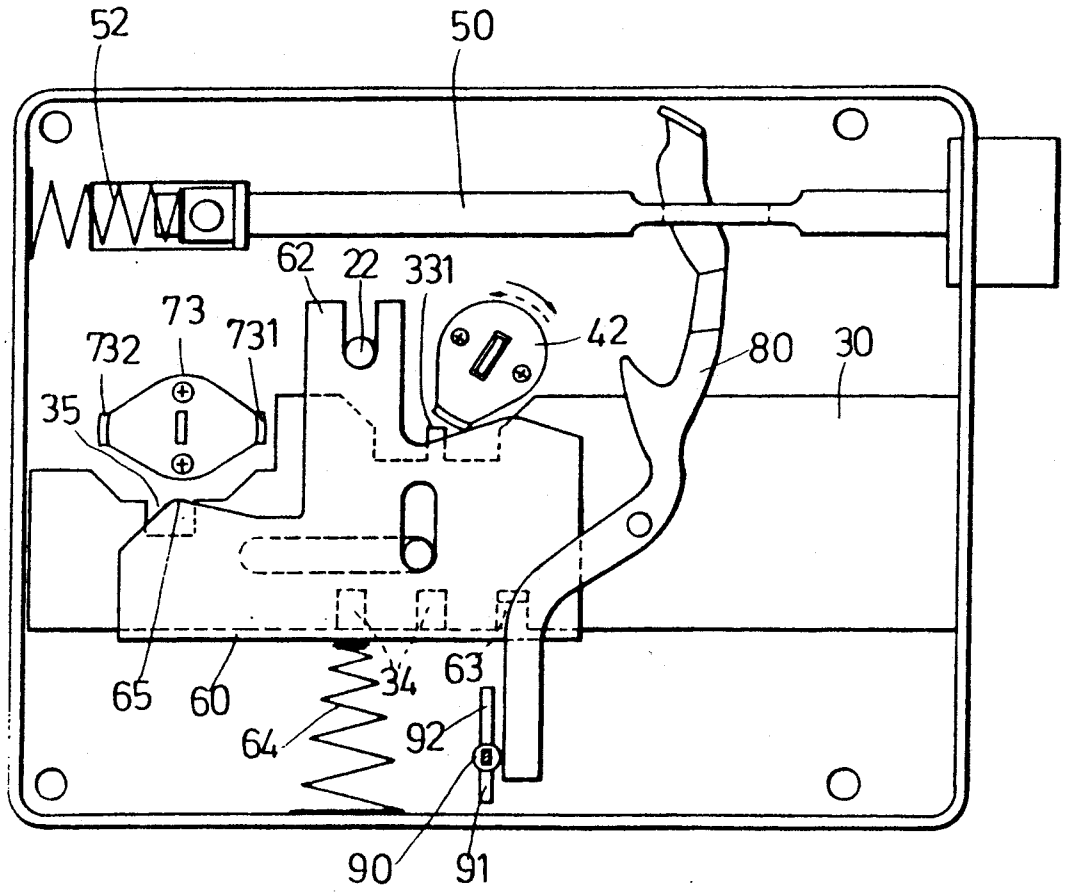

Referring again to FIG. 4, when the main bolt 30 is in its unlatching position, the boss 63 of the locking plate 60 extends foremost recess 34 of the bolt 30. If the key-operated lock 40 or 40' is operated by a key 100, the actuating plate 42 or 42' moves counter-clockwise, depressing the raised edge 67 of the locking plate 60 so that the boss 63 is released from the foremost recess 34 of the bolt 30. Subsequently, the actuating plate 42 or 42' advances a forward face 332 of the bolt 30 and moves the bolt 30 to a first-stage latching position, as shown in FIG. 6. When the key is turned subsequently, the actuating plate 42 or 42' makes a second counter-clockwise rotation, again depressing the locking plate 60 and pushing the projection 331 so that the bolt 30 is moved to a second-stage latching position thereof, as shown in FIG. 7. The bolt 30 placed in the latching position can be returned to its unlatching position by turning the actuating plate 42, 42' in the reverse direction, as shown in FIG. 8.

Figure 9:
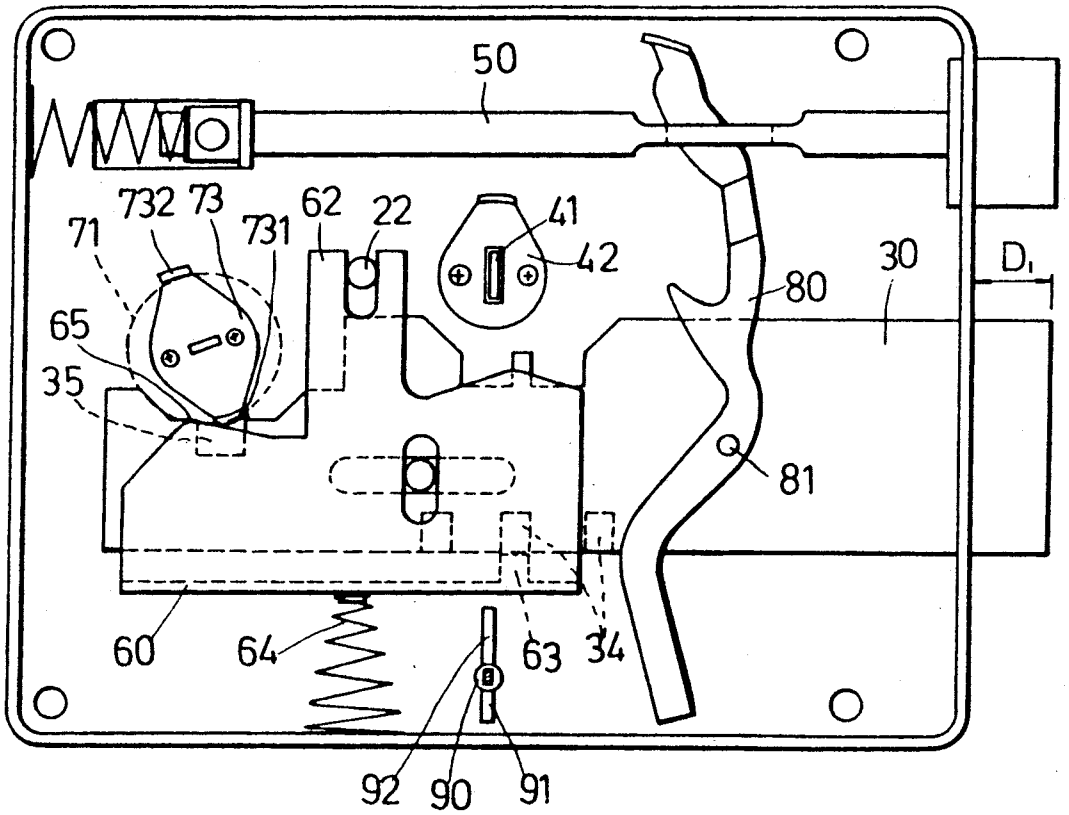
FIG. 9 shows the operation of the second actuating plate of the door lock.

The bolt 30 can be operated by means of the knob 71 from the inside of the door. When the knob 71 is turned, the actuating plate 73 turns counter-clockwise, depressing the locking plate 60 and pushing the face 351 of the bolt 30 so that the bolt 30 is moved to its first-stage latching position, as shown in FIG. 9. The bolt 30, which is held in its first-stage latching position by the interengagement of the boss 63 and an intermediate one of the recesses 34, can be moved to the unlatching position by operating either the knob 71 or the key-operated lock member 40'.

Figure 10:
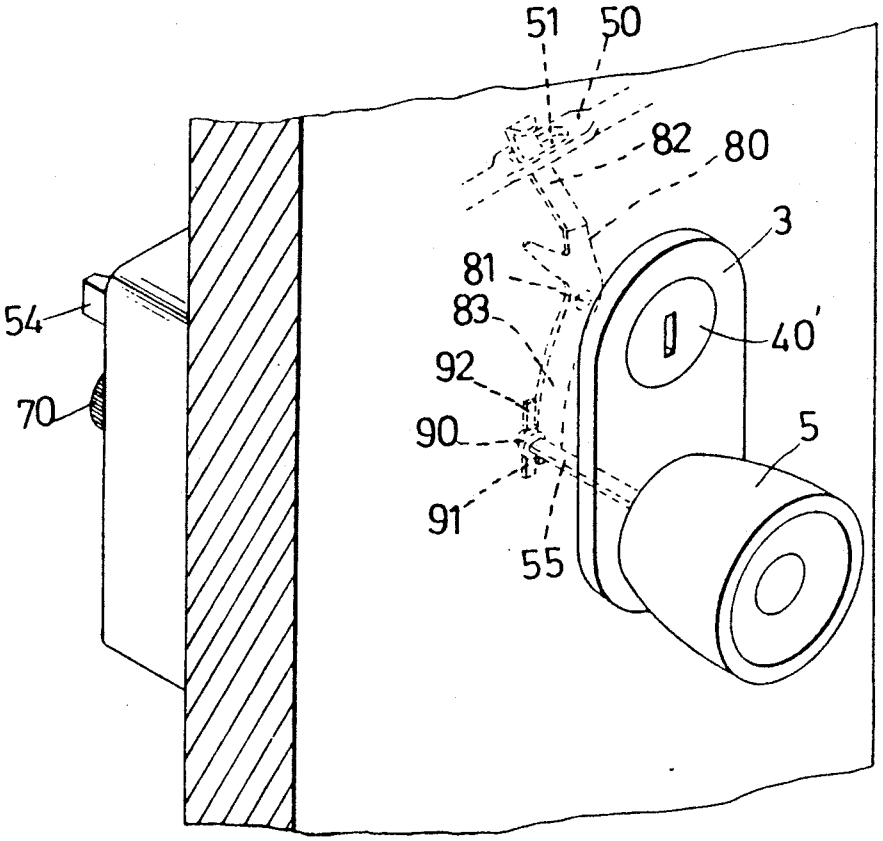
FIGS. 10 and 11 show the operation of a lever activating the first bolt of the door lock.
Figure 11:
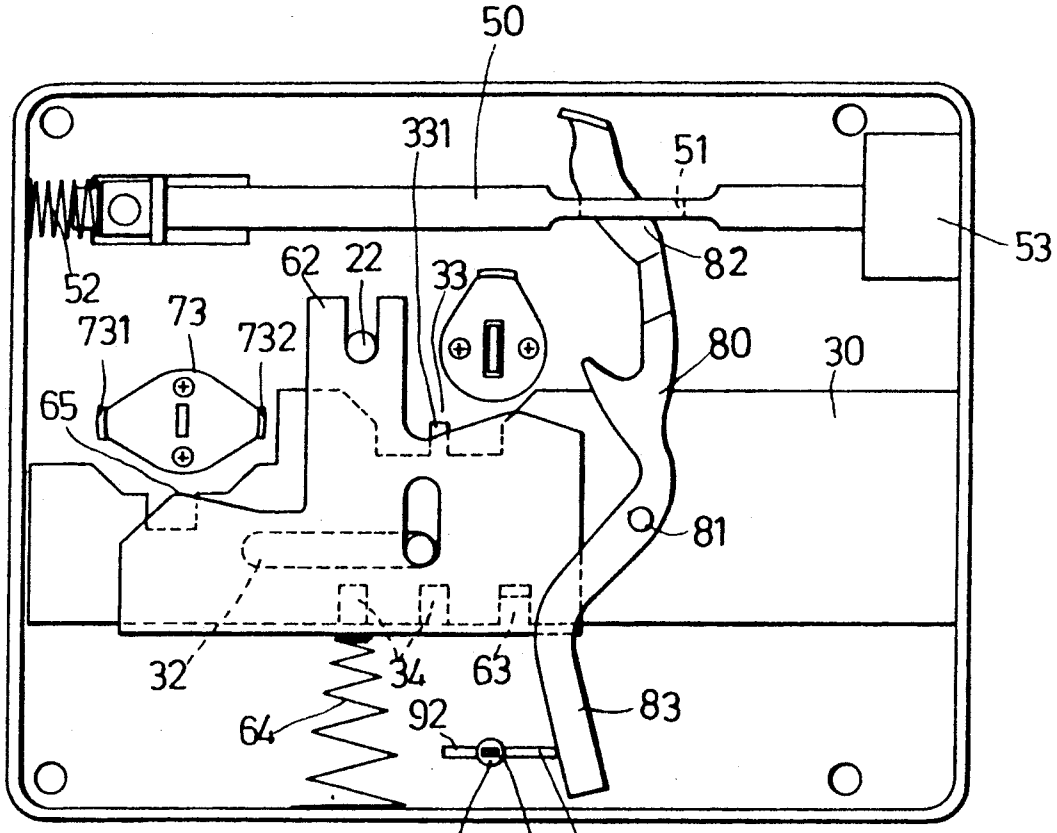

The auxiliary bolt 50 is normally biased to its latching position and can be moved to its unlatching position by operating the pull handle 54 at the inside of the door. Moreover, the bolt 50 can be operated at the outside of the door by using the knob 5 which actuates the lever 80 through the actuating member 90 as better shown in FIGS. 10 and 11. However, the bolt 50 cannot be actuated from the outside of the door when the bolt 30 is moved to its latching position as shown in FIG. 9.

With the invention thus explained, it is apparent that various modifications and variations can be made without departing from the scope of the invention. It is therefore intended that the invention be limited only as indicated in the appended claims.

What I claim is:

1. A door lock comprising:

a housing;

a first bolt member mounted movably to said housing and biased to a latching position;

means for operating said first bolt member externally;

an elongated second bolt member lying in said housing and mounted movably below said first bolt member, said second bolt member having a forward latching end, an opposite rear end and a longitudinal upper end with a first notched face near said forward latching end;

a pair of first actuating plates provided adjacent said first notched face and turnable about a horizontal axis to push said notched face so that said second bolt member is moved to a latching position or an unlatching position;

a locking plate cooperatively associated with said second bolt member and biased to move upward to a position in which said locking plate locks said second bolt member against movement, said locking plate releasing said second bolt when member depressed downward;

said second bolt member further including a second notched face in said upper end near said rear end of said second bolt member;

a second actuating plate provided adjacent to said second notched face to push said second notched face so as to move said second bolt member;

a lever pivoted to said second bolt member and having a first end extending upward to engage with said first bolt member and a second end extending downward; and a third actuating member disposed adjacent to said second end of said lever to actuate said second end so as to move said first bolt member to its unlatching position, thereby enabling the first bolt member to be operated from the outside of the door;

said second end of said lever moving away from said third actuating member when said second bolt member is moved to the latching position thereof, thereby preventing the first bolt member from moving to the unlatching position from the outside of the door.

2. A door lock as claimed in claim 1, wherein said housing has a cover which faces the outside of a door to which said door lock is attached, and an inner wall which faces the inside of said door, said door lock further comprising a first key-operated lock member which is mounted on said cover and connected to one of said first actuating plates.

3. A door lock as claimed in claim 2, further comprising a first operating knob which is mounted on said inner wall of said housing and connected to said second actuating plate.

4. A door lock as claimed in claim 2, further comprising a second key-operated lock member mounted on said inner wall of said housing and connected to another of said first actuating plates.

5. A door lock as claimed in claim 2, further comprising a second operating knob mounted on said cover of said housing to operate said third actuating member.

6. A door lock as claimed in claim 1, wherein said locking plate is of U-shaped cross-section and has two parallel side plates and a base interconnecting said parallel side plates, said second bolt member being provided between said parallel side plates, said base lying below a longitudinal bottom end of said second bolt member and being biased upward, said bottom end of said second bolt member having a plurality of engaging recesses adjacent to said base, said base having a projection boss which selectively engages with one of said recesses, each of said parallel side plates having a first upper raised edge portion adjacent to and higher than said first notched face and a second upper raised edge portion adjacent to and higher than said second notched face.

7. A door lock as claimed in claim 6, wherein said second bolt member is provided with a longitudinal slide opening, said parallel side plates of said locking plate are each provided with a slot which intersect said longitudinal slide opening, said door lock further including a pin which extends into said slide opening and said slots.

* * * * *